US005115606A

United States Patent [19]

Renegar et al.

[11] Patent Number: 5,115,606

[45] Date of Patent: May 26, 1992

[54] EXTENSION CABLE FOR TELESCOPIC TOWER

[75] Inventors: Jarvis K. Renegar, Mocksville; Jeffrey D. Matlock, Clemmons, both of N.C.

[73] Assignee: Ingersoll-Rand Company, Woodcliff Lake, N.J.

[21] Appl. No.: 587,777

[22] Filed: Sep. 24, 1990

[51] Int. Cl.[5] ..... B66C 23/06

[52] U.S. Cl. ..... 52/118; 248/158

[58] Field of Search ..... 248/158; 212/269, 267, 212/268, 201, 203; 362/383, 413; 182/2, 63; 52/118, 120, 110, 121; 254/400

[56] References Cited

U.S. PATENT DOCUMENTS

| | | | |
|---|---|---|---|
| 2,081,248 | 5/1937 | Murphy . | |
| 2,331,559 | 10/1943 | McEwen | 52/118 |
| 2,508,835 | 5/1950 | Moon | 52/118 |
| 2,896,750 | 7/1959 | Eitel | 52/118 X |
| 2,899,540 | 8/1959 | Allmand et al. . | |
| 2,920,725 | 1/1960 | Emmons | 52/118 |
| 3,495,364 | 2/1970 | Bella | 52/121 X |
| 3,586,270 | 6/1971 | Loffler et al. . | |
| 3,688,456 | 9/1972 | Igwe | 52/121 |
| 4,181,929 | 1/1980 | Barber et al. . | |
| 4,394,914 | 7/1983 | Privat | 212/203 X |
| 4,429,355 | 1/1984 | Garchinsky . | |
| 4,580,377 | 4/1986 | Sundin | 254/400 X |
| 4,657,112 | 4/1987 | Ream | 182/63 |
| 4,690,290 | 9/1987 | Gustafsson | 212/267 |
| 4,699,281 | 10/1987 | Kishi | 212/269 |

FOREIGN PATENT DOCUMENTS 1461375 12/1966 France .

*Primary Examiner*—J. Franklin Foss
*Attorney, Agent, or Firm*—Glenn B. Foster

[57] ABSTRACT

A portable light tower apparatus includes a portable chassis having a first tubular member mounted in the chassis. A second tubular member is at least partially contained within the first tubular member so that a space is formed between the first and second tubular members. A tensioner, attached to the first tubular member, applies tension to an associated cable. A pulley is also attached to the first tubular member. A first portion of the cable is connected at one end to the second tubular member, and extends to the pulley. A second portion of the cable extends from the pulley to the tensioner. The first and second cable portions are contained within the first tubular member.

14 Claims, 3 Drawing Sheets

EXTENSION CABLE FOR TELESCOPIC TOWER

BACKGROUND OF THE INVENTION

This invention relates generally to telescopic tower to support lights, tools and the like and more particularly to a cable configuration which permits extension of one tower portion with respect to another, wherein the cable is contained within the outermost tower portion.

The use of towers to support tools and lights is well known, as is the use of cables to extend a second tower portion relative to a first tower portion, wherein the first tower portion is contained within the second tower portion. The use of cable usually provides an inexpensive, efficient extension system.

In the prior cable operated tower extension systems, there is at least one cable portion which extends outside of the first tower portion. Having this cable portion contained outside of the outermost tower portion provides a rough surface which can easily catch on objects and people when the tower is being used, transported or stored.

Having the cable located outside of the outermost tube also makes the cable susceptible to damage and kinks, especially when the tower is being raised, lowered, or the entire tower and associated generator unit is being carried by a hook which is usually located on the tower.

The foregoing illustrates limitations known to exist in present telescopic tower. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a first tubular member and a second tubular member which is at least partially contained within the first tubular member wherein a space is formed between the first tubular member and the second tubular member. A cable is included. Tensioning means apply tension to the cable. Pulley means are attached to the first tubular member for engaging the cable. A first portion of the cable is connected at one end to the second tubular member, and extends to the pulley means. A second portion of the cable extends from said pulley means to the tensioning means. The first and second cable portions are contained within the first tubular member.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
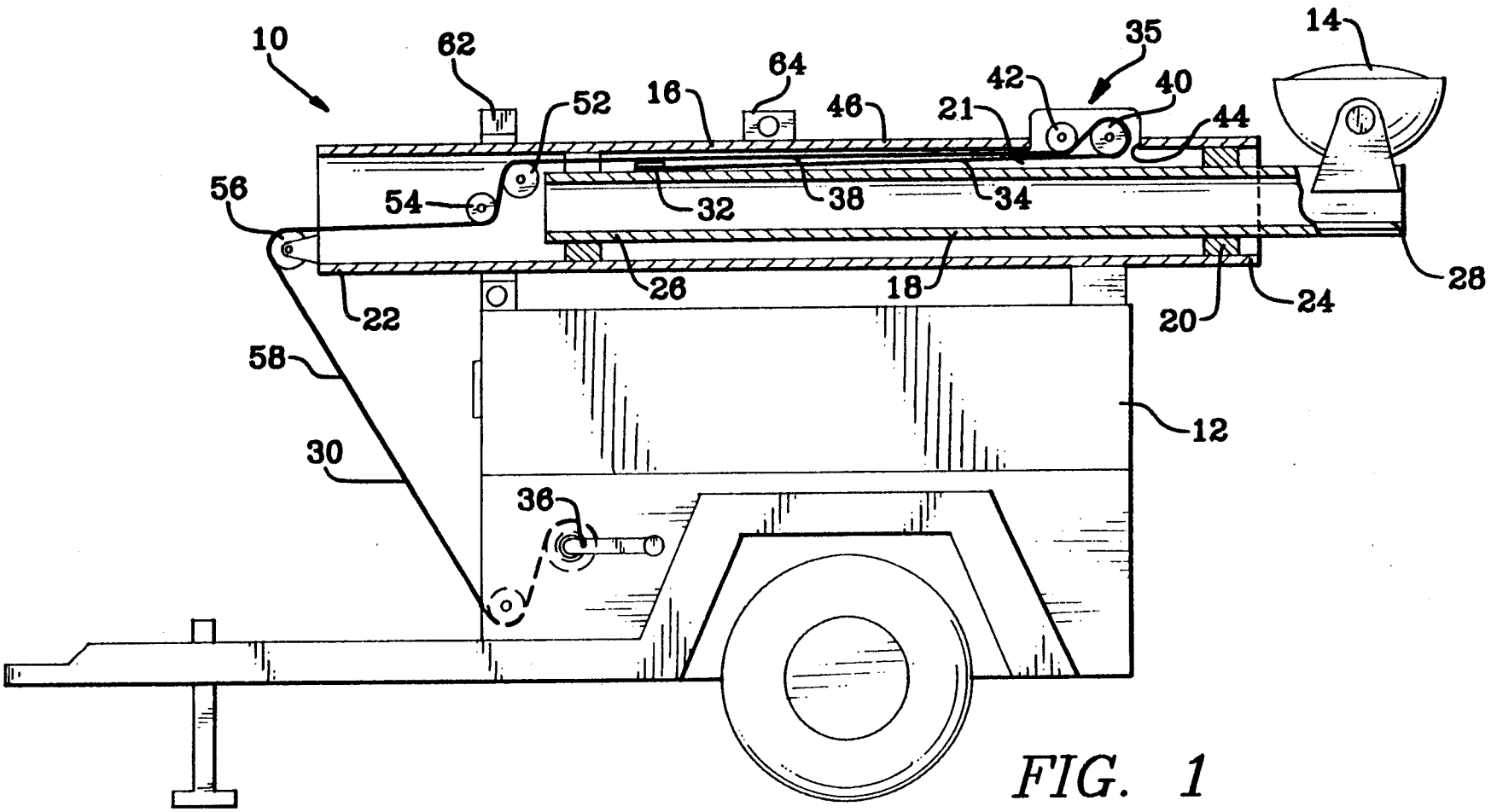
FIG. 1 is a side elevational view illustrating an embodiment of a vehicle with a telescopic tower of the instant invention, with the tower in a lowered position, the telescopic tower is shown in cross section.

In this description, identical elements in different embodiments are referenced by identical reference characters.

A telescopic tower 10 is transportable and supported by a vehicle 12. A generator (not shown) is contained within the vehicle 12 to supply power to whichever lights or tools 14 are supported by the tower.

The tower 10 includes first tubular member 16 and a second tubular member 18 which are of the solid wall variety. The tubular members 16 and 18 have a circular, rectangular or other suitable cross section. The tubular members may include guides 20 whereby the second tubular member may be slidably displaced within the first tubular member to effect the relative telescoping between the first and the second tubular members. A space 21 is defined between the first and the second tubular members 16,18.

The first tubular member 16 has a first end 22 and a second end 24. The second tubular portion 18 has a third end 26 and a fourth end 28. A direction from the first end to the second end is going to be substantially identical to a direction from the third end to the forth end.

A cable 30 is used to raise the second tubular member 18 relative to the first tubular member 16. A cable end 32 of the cable 30 is attached to the third end 26. A pulley means 35 is attached to the second end 24 of the first tubular member 16. A cable portion which extends from the cable end to the pulley means defines a first length 34 of the cable 30.

The cable continues around the pulley means 35 to a tensioning means 36, this cable portion defines a second length 38 of the cable 30. Both the first length 34 and the second length 38 of the cable are fully contained within the first tubular member 16. The first tubular member 16 thereby acts as a shield to protect the cable 30 from excessive abrasion and kinks.

Figure 2:
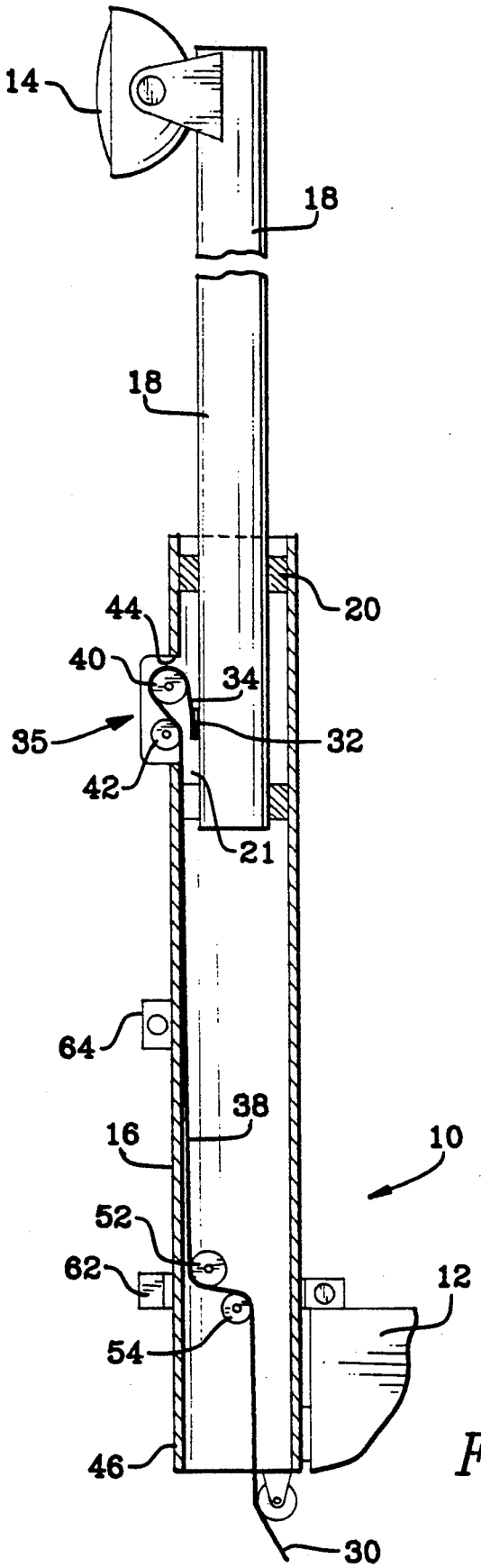
FIG. 2 is a view similar to FIG. 1 of a portion of the vehicle with the tower, the tower is in a raised position.

There are two pulley means 35 designs. FIGS. 1 and 2 illustrate the first design in which a first pulley 40 and a second pulley 42 are mounted in an aperture 44 formed in a wall 46 of the first tubular member 16. The first pulley 40 acts to reverse the direction of the cable 30. The second pulley 42 acts to direct the cable 30 into the space 21.

Figure 3:
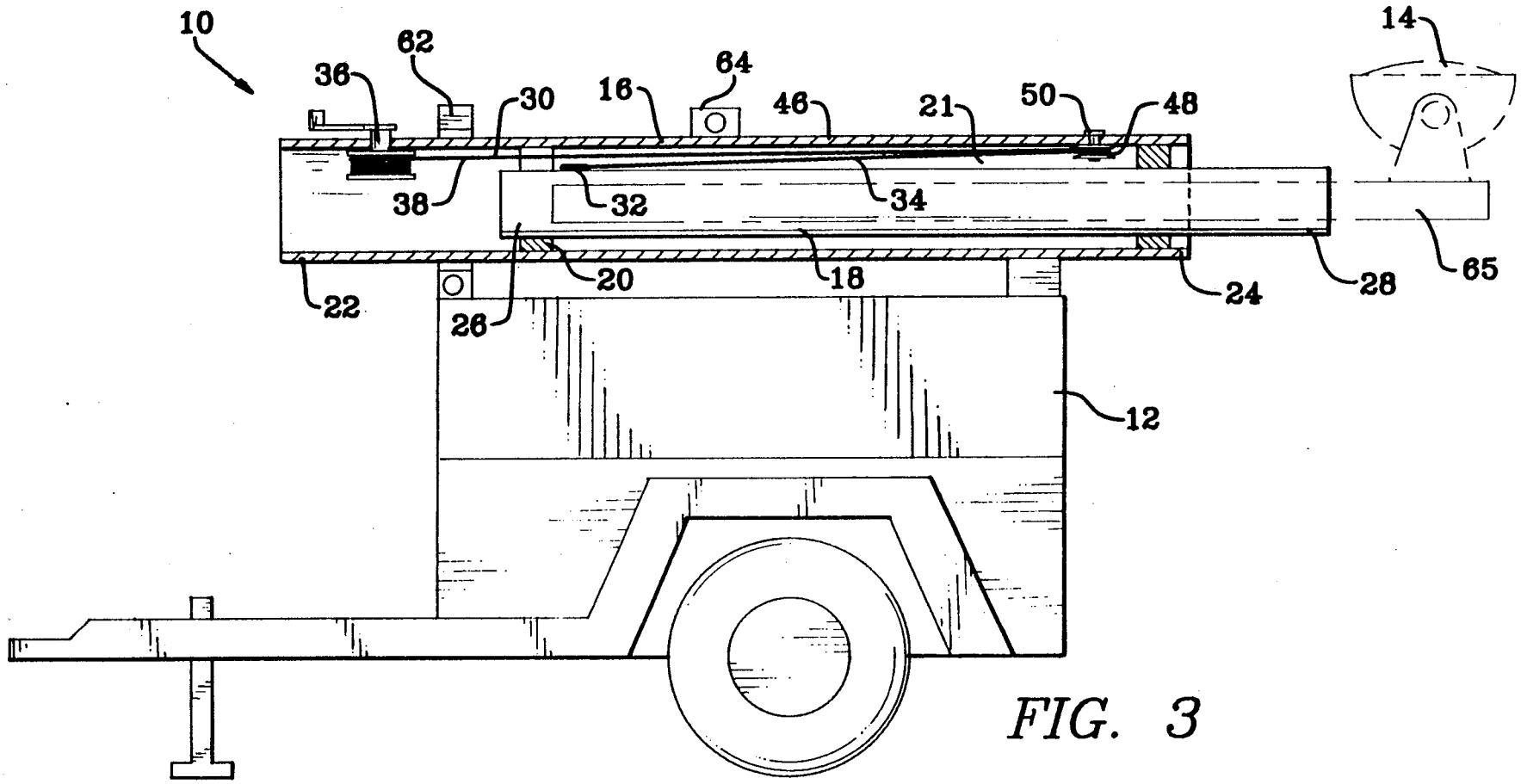
FIG. 3 is a view similar to FIG. 1, of an alternate embodiment of the invention.

The second pulley means 35 design, illustrated in FIG. 3, involves a pulley 48 which is rotatably attached by a fastener 50 to the wall 46 of the first tubular member 16.

There are two tensioning means 36 configuration. In the first configuration (see FIG. 1), the second length 38 of the cable 30 ends at a directing device 50 which includes a plurality of pulleys 52, 54 and 56. A third length 58 of the cable 30 then extends outside of the tower 10, and continues to tensioning device 60.

A securement portion 62 is attached to the vehicle 12, and permits pivotal raising of the tower 10 relative to the vehicle. In this manner, a single cable and tensioning device 60 can be used both to raise the tower and to extend the second tubular member 18 relative to the first telescopic member 16.

In the second tensioning means 36 configuration (illustrated in FIG. 3), a tensioning device 62, such as a motor, may be mounted near the first end 22. In this configuration, the tower 10 must be raised manually by pivoting the tower around the securement portion 62, and then the tensioning device can be operated to raise the second tubular member 18 relative to the first tubular member 16.

There may be a third tubular member 64 (see FIG. 3 in phantom) which is telescopically disposed within the second tubular member. Any of the well known techniques to extend one tubular member relative to another may be used in this application.

A hook member 64 is mounted on an external surface of the first tubular member to permit lifting of the vehicle 12 and tower 10.

Having described the invention, what is claimed is:

1. An apparatus comprising:

a first solid wall tubular member;

a second solid wall tubular member being at least partially contained within the first solid wall tubular member wherein a space is defined between the first solid wall tubular member and second solid wall tubular member;

a cable;

tensioning means for applying tension to the cable;

pulley means attached to said first solid wall tubular member for engaging the cable, at least a portion of the pulley means being located within said space and at least a portion of the pulley means being located externally of the first solid wall tubular member;

a first portion of the cable is connected at one end to the second solid wall tubular member, and extends to the pulley means; and a second portion of the cable extends from said pulley means to the tensioning means, the first and second cable portions being contained within the first solid wall tubular member.

2. The apparatus as described in claim 1, wherein the tensioning means comprises:

a tensioning device contained within the first solid wall tubular member.

3. The apparatus as described in claim 1, wherein the tensioning means comprises:

a tensioning device contained externally of the first solid wall tubular member.

4. The apparatus as described in claim 3, further comprising:

a support means for pivotally supporting the first solid wall tubular member between a raised and a lowered position, wherein said tensioning device may also be used to displace the first tubular member between the raised position and lowered position.

5. The apparatus as described in claim 3, wherein the tensioning means comprises a directing device contained within the first solid wall tubular member which directs a third portion of cable externally of the first solid wall tubular member.

6. The apparatus as described in claim 1, wherein the pulley means includes a plurality of pulleys.

7. The apparatus as described in claim 1, further comprising:

a third solid wall tubular member being extendably disposed within the second solid wall tubular member.

8. A portable light tower apparatus comprising:

a portable chassis;

a first solid wall tubular member mounted on the chassis;

a second solid wall tubular member being at least partially contained within the first solid wall tubular member wherein a space is formed between the first solid wall tubular member and the second solid wall tubular member;

a cable;

tensioning means for applying tension to the cable;

pulley means attached to said first solid wall tubular member, at least a portion thereof being located within said space and at least a portion thereof being located externally of the first solid wall tubular member, for engaging the cable;

a portion of the cable is connected at one end to the second solid wall tubular member, and extends to the pulley means; and a second portion of the cable extends from said pulley means to the tensioning means, the first and second cable portions being contained within the first solid wall tubular member.

9. The apparatus as described in claim 8, wherein the tensioning means comprises:

a tensioning device contained within the first solid wall tubular member.

10. The apparatus as described in claim 8, wherein the tensioning means further comprises:

a tensioning device contained externally of the first solid wall tubular member.

11. The apparatus as described in claim 10, further comprising:

a support means for pivotally supporting the first solid wall tubular member between a raised and a lowered position, wherein said tensioning device may also be used to displace the first solid wall tubular member between the raised position and lowered position.

12. The apparatus as described in claim 10, wherein the tensioning means comprises a directing device contained within the first solid wall tubular member which directs, a third portion of cable externally of the first solid wall tubular member.

13. The apparatus as described in claim 8, wherein the pulley means includes a plurality of pulleys.

14. The apparatus as described in claim 8, further comprising:

a third solid wall tubular member being extendably disposed within the second tubular member.

* * * * *